US011316285B2

(12) United States Patent
Wu et al.

(10) Patent No.: US 11,316,285 B2
(45) Date of Patent: Apr. 26, 2022

(54) ANTENNA STRUCTURE AND COMMUNICATION DEVICE

(71) Applicant: PEGATRON CORPORATION, Taipei (TW)

(72) Inventors: Chien-Yi Wu, Taipei (TW); Hau Yuen Tan, Taipei (TW); I-Shu Lee, Taipei (TW); Hung-Ming Yu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 15 days.

(21) Appl. No.: 17/096,624

(22) Filed: Nov. 12, 2020

(65) Prior Publication Data

US 2021/0159611 A1 May 27, 2021

(30) Foreign Application Priority Data

Nov. 27, 2019 (TW) ..... 108143208

(51) Int. Cl.
*H01Q 21/30* (2006.01)
*H01Q 9/42* (2006.01)

(52) U.S. Cl.
CPC ..... *H01Q 21/30* (2013.01); *H01Q 9/42* (2013.01)

(58) Field of Classification Search
CPC ..... H01Q 9/42; H01Q 21/30
See application file for complete search history.

(56) References Cited

U.S. PATENT DOCUMENTS

2007/0273606 A1 11/2007 Mak et al.

FOREIGN PATENT DOCUMENTS

CN 106229674 12/2016
TW I637561 10/2018

*Primary Examiner* — Graham P Smith
(74) *Attorney, Agent, or Firm* — J.C. Patents

(57) ABSTRACT

An antenna structure including a first radiator and a second radiator is provided. The first radiator includes a first segment, a second segment, a third segment, and a fourth segment all bent to be connected in sequence, in which the first segment includes a feed-in terminal. The second radiator includes a fifth segment, and a sixth segment, a seventh segment, an eighth segment, and a ninth segment which are connected respectively to the fifth segment, in which the fifth segment is located beside the first radiator while a first slit is formed between the first radiator and the fifth segment of the second radiator, the sixth segment includes a ground terminal, and the first radiator and the second radiator are adapted to couple to form a first frequency band, a second frequency band, a third frequency band, and a fourth frequency band.

22 Claims, 6 Drawing Sheets

ANTENNA STRUCTURE AND COMMUNICATION DEVICE

CROSS-REFERENCE TO RELATED APPLICATION

This application claims the priority benefit of Taiwan application serial no. 108143208, filed on Nov. 27, 2019. The entirety of the above-mentioned patent application is hereby incorporated by reference herein and made a part of this specification.

BACKGROUND

Technical Field

The disclosure relates to an antenna structure and a communication device, and particularly to a multi-frequency band antenna structure and a multi-frequency band communication device.

Related Art

Sub 6 GHz is one of the mainstream frequency bands for 5G communication. In addition to the frequency band of 698 MHz to 960 MHz and the frequency band of 1710 MHz to 2700 MHz, the frequency band of 617 MHz to 698 MHz, the frequency band of 3300 MHz to 5000 MHz and the frequency band of 5150 MHz to 5850 MHz are also added to it. It is the current research goal to design an antenna that covers multiple frequency bands.

SUMMARY

The antenna structure of the disclosure includes a first radiator and a second radiator. The first radiator includes a first segment, a second segment, a third segment, and a fourth segment all bent to be connected in sequence, in which the first segment includes a feed-in terminal. The second radiator includes a fifth segment, a sixth segment, a seventh segment, an eighth segment, and a ninth segment, wherein the sixth segment, the seventh segment, the eighth segment, and the ninth segment are connected respectively to the fifth segment, the fifth segment is located beside the first radiator, a first slit is formed between the first radiator and the fifth segment of the second radiator, the sixth segment includes a ground terminal, and the first radiator and the second radiator are adapted to couple to form a first frequency band, a second frequency band, a third frequency band, and a fourth frequency band.

In an embodiment of the disclosure, the first frequency band is between 617 MHz and 960 MHz, the second frequency band is between 1710 MHz and 2700 MHz, the third frequency band is between 3300 MHz and 5000 MHz, and the fourth frequency band is between 5150 MHz and 5850 MHz.

In an embodiment of the disclosure, a second slit is formed between the first segment and the third segment of the first radiator, and the second slit is suitable for adjusting impedance matching of the third frequency band.

In an embodiment of the disclosure, the antenna structure further includes a first antenna lumped element, which is disposed at the first slit and connects the first radiator to the second radiator in series. The first antenna lumped element is suitable for adjusting impedance matching of the second frequency band, the third frequency band, and the fourth frequency band.

In an embodiment of the disclosure, the antenna structure further includes a second antenna lumped element. A third slit is formed between the fifth segment and the sixth segment. The second antenna lumped element is disposed on the second slit and connects the fifth segment to the sixth segment in series. The second antenna lumped element is suitable for adjusting impedance matching of the first frequency band.

In an embodiment of the disclosure, the seventh segment includes a meandering zone and a widened zone. The meandering zone is in a line shape bending back and forth. One terminal of the meandering zone is connected to the fifth segment, and the other terminal of the meandering zone is connected to the widened zone. The widened zone is located at a side of the eighth segment opposite to the ninth segment. The width of the meandering zone is smaller than the width of the widened zone.

In an embodiment of the disclosure, the sixth segment, the seventh segment, the eighth segment, and the ninth segment extend in the same direction and are not connected to one another.

In an embodiment of the disclosure, the antenna structure further includes an insulating bracket having a first long side, a second long side, and a third long side. Part of the first segment and part of the fourth segment of the first radiator as well as part of the fifth segment and the sixth segment of the second radiator are distributed on the first long side of the insulating bracket. The remaining part of the first segment, part of the second segment, part of the third segment, and another part of the fourth segment of the first radiator as well as part of the fifth segment and the seventh segment of the second radiator are distributed on the second long side of the insulating bracket. The remaining part of the second segment, the remaining part of the third segment, and the remaining part of the fourth segment of the first radiator as well as the eighth segment and the ninth segment of the second radiator are distributed on the third long side of the insulating bracket.

In an embodiment of the disclosure, the insulating bracket includes a length, a width and a height, the length is between 75 mm and 95 mm, the width is between 8 mm and 10 mm, and the height is between 8 mm and 10 mm.

A communication device of the disclosure includes the aforementioned antenna structure, a plurality of switch lumped elements, and a switch. The first frequency band includes a plurality of sub-intervals. The switch lumped elements are connected to a system ground plane. A plurality of ground paths exist between the antenna structure and the system ground plane, and the ground paths correspond respectively to the sub-intervals of the first frequency band. One terminal of the switch is connected to the ground terminal of the antenna structure, and the other terminal may be connected selectively to at least one of the switch lumped elements to connect the antenna structure to at least one of the ground paths and resonate at least one of the sub-intervals of the first frequency band.

According to an embodiment of the disclosure, the switch lumped elements include a capacitance or an inductance.

In an embodiment of the disclosure, the switch lumped elements include a first switch lumped element, a second switch lumped element, and a third switch lumped element. The ground paths include a plurality of ground paths. The sub-intervals of the first frequency band include a first sub-interval and a second sub-interval. When the switch is connected to the third switch lumped element, the antenna structure is suitable for resonating at the first sub-interval of the first frequency band. And when the switch is connected to the first switch lumped element, the second switch lumped element, and the third switch lumped element, the antenna structure is suitable for resonating at the second sub-interval of the first frequency band.

In an embodiment of the disclosure, the first switch lumped element, the second switch lumped element, and the third switch lumped element are respectively three inductances. The inductance value of the third switch lumped element is greater than the inductance value of the second switch lumped element. And the inductance value of the second switch lumped element is greater than the inductance value of the first switch lumped element.

According to an embodiment of the disclosure, the first sub-interval is between 617 MHz and 800 MHz, and the second sub-interval is between 800 MHz and 960 MHz.

Based on the above, the antenna structure of the disclosure is suitable for coupling to form the first frequency band, the second frequency band, the third frequency band, and the fourth frequency band via the design in which the first radiator includes the first segment, the second segment, the third segment, and a fourth segment all bent to be connected in sequence, and the second radiator includes the fifth segment, and the sixth segment, the seventh segment, the eighth segment, and the ninth segment which are connected respectively to the fifth segment, and the fifth segment is located beside the first radiator while the first slit is formed between the first radiator and the fifth segment of the second radiator. Therefore, the antenna structure of the disclosure may achieve the effect of supporting multiple frequency bands. In addition, the communication device of the disclosure may select different ground paths such that the first frequency band may reach a larger coverage of bandwidth via the design of connecting one terminal of the switch to the ground terminal of the antenna structure and connecting the other terminal selectively to at least one of the switch lumped elements.

DESCRIPTION OF THE EMBODIMENTS

Figure 1:
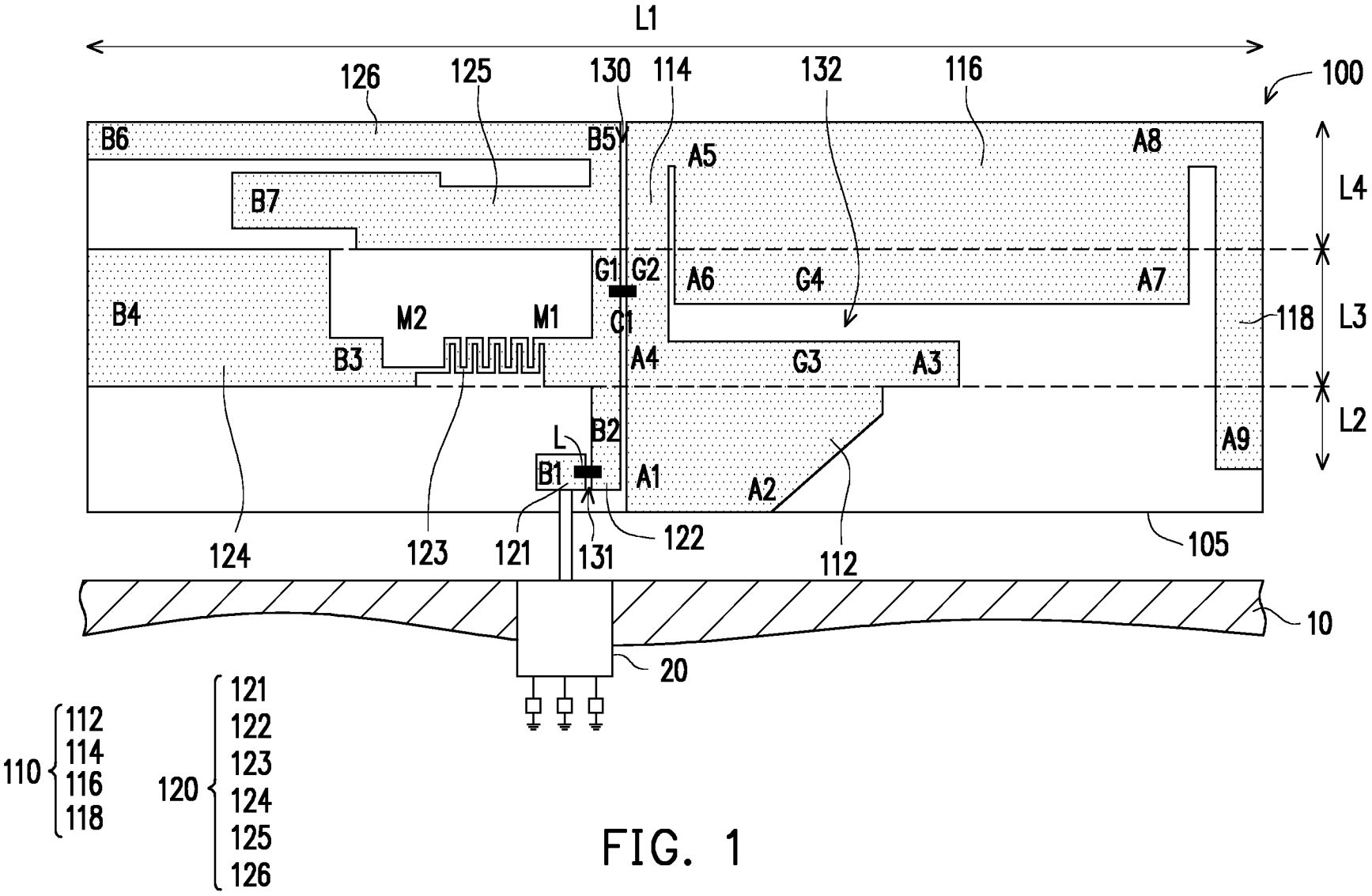
FIG. 1 is a schematic view of an antenna structure of a communication device according to an embodiment of the disclosure.

FIG. 1 is a schematic view of an antenna structure of a communication device according to an embodiment of the disclosure. FIG. 1 shows that the communication device of the present embodiment includes an antenna structure 100, a plurality of switch lumped elements (labeled in FIG. 2, such as a first switch lumped element 32, a second switch lumped element 34, and a third switch lumped element 36), and a switch 20. The antenna structure 100 is disposed on a substrate 105. The substrate 105 may be, for example, a flexible circuit board disposed flexibly on a structure, such as an insulating bracket 30 (see FIG. 3). However, the type of the substrate 105 is not limited thereto.

As FIG. 1 shows, in the present embodiment, the antenna structure 100 includes a first radiator 110 and a second radiator 120. The first radiator 110 includes a first segment 112 (locations A1, A2, A3, and A4), a second segment 114 (locations A4 and A5), a third segment 116 (locations A5, A6, A7, and A8), and a fourth segment 118 (locations A8 and A9). The first segment 112 includes a feed-in terminal (location A1). The feed-in terminal (position A1) is suitable for being electrically connected to a signal positive terminal of a modem (not illustrated) or a motherboard (not illustrated).

In the present embodiment, the first segment 112 is bent to connect the second segment 114, the second segment 114 is bent to connect the third segment 116, and the third segment 116 is bent to connect the fourth segment 118. The extending direction of the first segment 112 is parallel to the extending direction of the third segment 116, the extending direction of the second segment 114 is parallel to the extending direction of the fourth segment 118, and the first segment 112 is located next to the third segment 116.

The second radiator 120 includes a fifth segment 122 (positions B2 and B5), a sixth segment 121 (position B1), a seventh segment (positions M1, M2, B3, and B4), an eighth segment 125 (B7 and the place above position G1), and a ninth segment 126 (positions B5 and B6), the fifth segment 122 (positions B2 and B5), the sixth segment 121 (position B1), the seventh segment (positions M1, M2, B3, and B4), the eighth segment 125 (B7 and the place above position G1), and the ninth segment 126 (positions B5 and B6) are connected respectively to the fifth segment 122 (positions B2 and B5). In the present embodiment, the sixth segment 121, the seventh segment, the eighth segment 125, and the ninth segment 126 extend in the same direction (for example, the left and right directions as in FIG. 1) and are not connected to one another.

The fifth segment 122 is located beside the first radiator 110, and a first slit 130 (between positions G1 and G2) is formed between the first radiator 110 and the fifth segment 122 of the second radiator 120. In the present embodiment, the width of the first slit 130 is between 0.3 mm and 0.5 mm, but the width of the first slit 130 is not limited thereto.

In addition, the sixth segment 121 includes a ground terminal. The ground terminal (position B1) is suitable for being electrically connected to a signal negative terminal of the motherboard. In addition, the seventh segment includes a meandering zone 123 (positions M1 and M2) and a widened zone 124 (positions B3 and B4) connected to each other. The meandering zone 123 is in a line shape which bends back and forth. One terminal of the meandering zone 123 is connected to the fifth segment 122, and the other terminal of the meandering zone 123 is connected to the widened zone 124. The widened zone 124 is configured to be located on one side of the eighth segment 125 opposite to the ninth segment 126 and extend in a direction opposite to the fifth segment 122. The width of the meandering zone 123 is smaller than the width of the widened zone 124.

The antenna structure 100 is suitable for coupling to form a first frequency band, a second frequency band, a third frequency band, and a fourth frequency band. In an embodiment of the disclosure, the first frequency band is between 617 MHz and 960 MHz, the second frequency band is between 1710 MHz and 2700 MHz, the third frequency band is between 3300 MHz and 5000 MHz, and the fourth frequency band is between 5150 MHz and 5850 MHz, but the first frequency band, the second frequency band, the third frequency band, and the fourth frequency band are not limited thereto.

In the present embodiment, the second segment 114, the third segment 116, and the fourth segment 118 of the first radiator 110 and the seventh segment (the meandering zone 123 and the widened zone 124) of the second radiator 120 are suitable for adjusting impedance matching of the first frequency band. More specifically speaking, the path formed by positions A4, A5, A8, and A9 is adapted to adjust the position of the resonance frequency point at a low frequency, the path formed by positions M1 and M2 is adapted to adjust the position of the resonance frequency point at 900 MHz, and the path formed by positions B3 and B4 is adapted to adjust the position of the resonance frequency point at 800 to 960 MHz.

In addition, the ninth segment 126 of the second radiator 120 is suitable for adjusting the second frequency band. More specifically speaking, the path formed by positions B5 and B6 is adapted to adjust the position of the resonance frequency point at 1710 to 2690 MHz.

In addition, the first segment 112 of the first radiator 110 is suitable for adjusting the third frequency band and the fourth frequency band. More specifically, the path formed by positions A2 and A3 is adapted to adjust the position of resonance frequency point at 3.3 to 5 GHz, and the path formed by positions A1 and A2 is adapted to adjust the position of resonance frequency point at 5150 to 5850 MHz.

Furthermore, the antenna structure 100 of the present embodiment may also adjust impedance matching through the following design. To put it in detail, the third segment 116 (positions A5, A6, A7, and A8) of the first radiator 110 is suitable for adjusting impedance matching of the first frequency band whereas the sixth segment 121 (positions B1, L1, and B2), the fifth segment 122 (positions B2 and B5), and the ninth segment 126 (positions B5 and B6) are suitable for adjusting impedance matching of the first frequency band. The first slit 130 (positions G1 and G2) is adapted to adjust impedance matching bandwidth at 617 to 800 MHz.

A second slit 131 (positions G3 and G4) is formed between the first segment 112 and the third segment 116 of the first radiator 110, and the second slit 131 is suitable for adjusting impedance matching of the third frequency band.

The antenna structure 100 further includes a first antenna lumped element C1, which is disposed at the first slit 130 and connects the first radiator 110 to the second radiator 120 in series. The first antenna lumped element C1 is suitable for adjusting impedance matching of the second frequency band, the third frequency band, and the fourth frequency band (i.e., 1710 MHz to 5850 MHz). In the present embodiment, the first antenna lumped element C1 may be an L/C element with a capacitance of 1.2 pF, but the type of the first antenna lumped element C1 is not limited thereto.

The antenna structure 100 further includes a second antenna lumped element L. A third slit 132 is formed between the fifth segment 122 and the sixth segment 121. The second antenna lumped element L is disposed a the second slit 131 and connects the fifth segment 122 to the sixth segment 121 in series. The second antenna lumped element L is suitable for adjusting the first frequency band. For example, the second antenna lumped element L (for example, an L/C element with an inductance value of 5.1 nH) may be adapted to adjust the position of resonance frequency point at 960 MHz, but the type of the second antenna lumped element L is not limited thereto.

In addition, as shown in FIG. 1, the length L1 of the antenna structure 100 is between 75 mm and 95 mm, such as 85 mm. The total width of the antenna structure 100 is the sum of lengths L2, L3, and L4. In the present embodiment, the length L2 is between 8 mm and 10 mm, such as 9 mm; the length L3 is between 8 mm and 10 mm, such as 10 mm; and the length L4 is between 8 mm and 10 mm, such as 9 mm. Of course, the above dimensions of the lengths L1, L2, L3, and L4 are not limited thereto.

Figure 2:
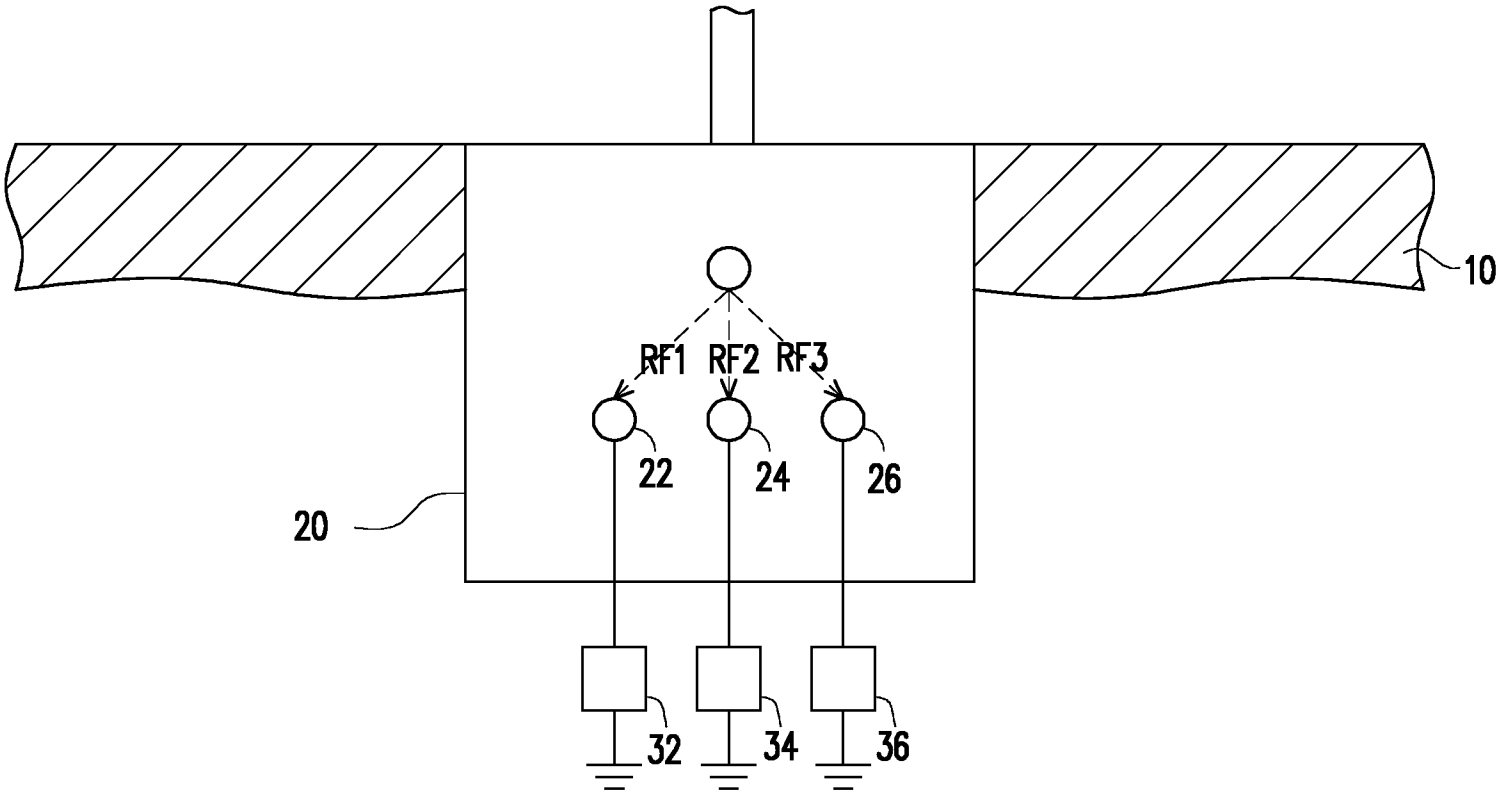
FIG. 2 is a schematic view of a switch of the communication device according to FIG. 1.

FIG. 2 is a schematic view of a switch of the communication device according to FIG. 1. As shown in FIG. 2, a first switch lumped element 32, a second switch lumped element 34, and a third switch lumped element 36 are connected to a system ground plane 10. One terminal of a switch 20 is connected to the ground terminal (position B1) of the antenna structure 100, and the other terminal is connected selectively to at least one of the first switch lumped element 32, the second switch lumped element 34, and the third switch lumped element 36.

The switch lumped elements include a capacitor or an inductor, but the type of switch lumped elements is not limited thereto. In the present embodiment, the first switch lumped element 32, the second switch lumped element 34, and the third switch lumped element 36 are respectively three inductances. The inductance value of the third switch lumped element 36 is greater than the inductance value of the second switch lumped element 34. And the inductance value of the second switch lumped element 34 is greater than the inductance value of the first switch lumped element 32.

For example, the inductance value of the first switch lumped element 32 is, for example, 1.2 nH; the inductance value of the first switch lumped element 32 is, for example, 2.7 nH; and the inductance value of the first switch lumped element 32 is, for example, 4.7 nH; but the first inductance values of the first switch lumped element 32, the second switch lumped element 34, and the third switch lumped element 36 are not limited thereto.

The ground terminal (position B1) of the first radiator 110 is connected to the switch 20 on the motherboard (not illustrated), such that different ground paths (RF1, RF2, and RF3) may be selected through the switch 20, and it may be switched to connect to different contacts 22, 24, and 26, and thus connect to the first switch lumped element 32, the second switch lumped element 34, and the third switch lumped element 36.

When the antenna structure 100 is connected to the system ground plane 10 through at least one of the ground paths (RF1, RF2, and RF3), it is suitable for resonating at one of the sub-intervals of the first frequency band, so that the first frequency band (low frequency) may cover the bandwidth from 617 to 960 MHz.

For example, in the present embodiment, the sub-intervals of the first frequency band include a first sub-interval (617 MHz to 800 MHz) and a second sub-interval (800 MHz to 960 MHz). When the switch 20 is in mode 1, it is connected to the third switch lumped element 36 through the ground path RF3, and the antenna structure 100 is adapted to resonate at the first sub-interval of the first frequency band. When the switch 20 is in mode 2, it is connected to the first switch lumped element 32, the second switch lumped element 34, and the third switch lumped element 36 respectively through the ground paths RF1, RF2, and RF3, and the antenna structure 100 is adapted to resonate at the second sub-interval of the first frequency band.

In the present embodiment, the switch 20 is, for example, a one-to-three switch 20, but the type of the switch 20 is not limited thereto. In other embodiments, the switch 20 may also be a one-to-two, one-to-four, one-to-five, or one-to-more switch 20.

Figure 3:
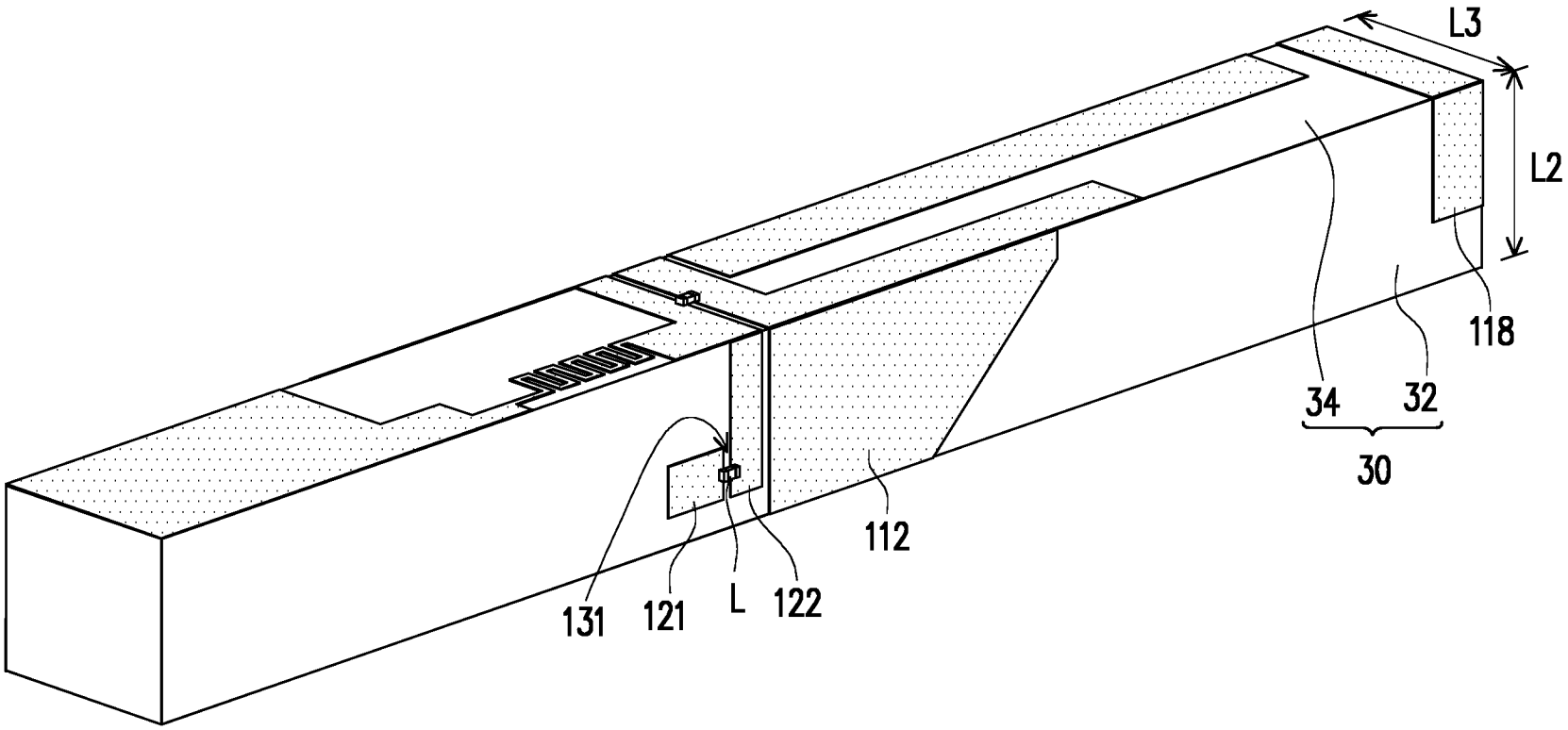
FIG. 3 to FIG. 5 are schematic views of the antenna structure according to FIG. 1 disposed on different sides of an insulating bracket.
Figure 4:
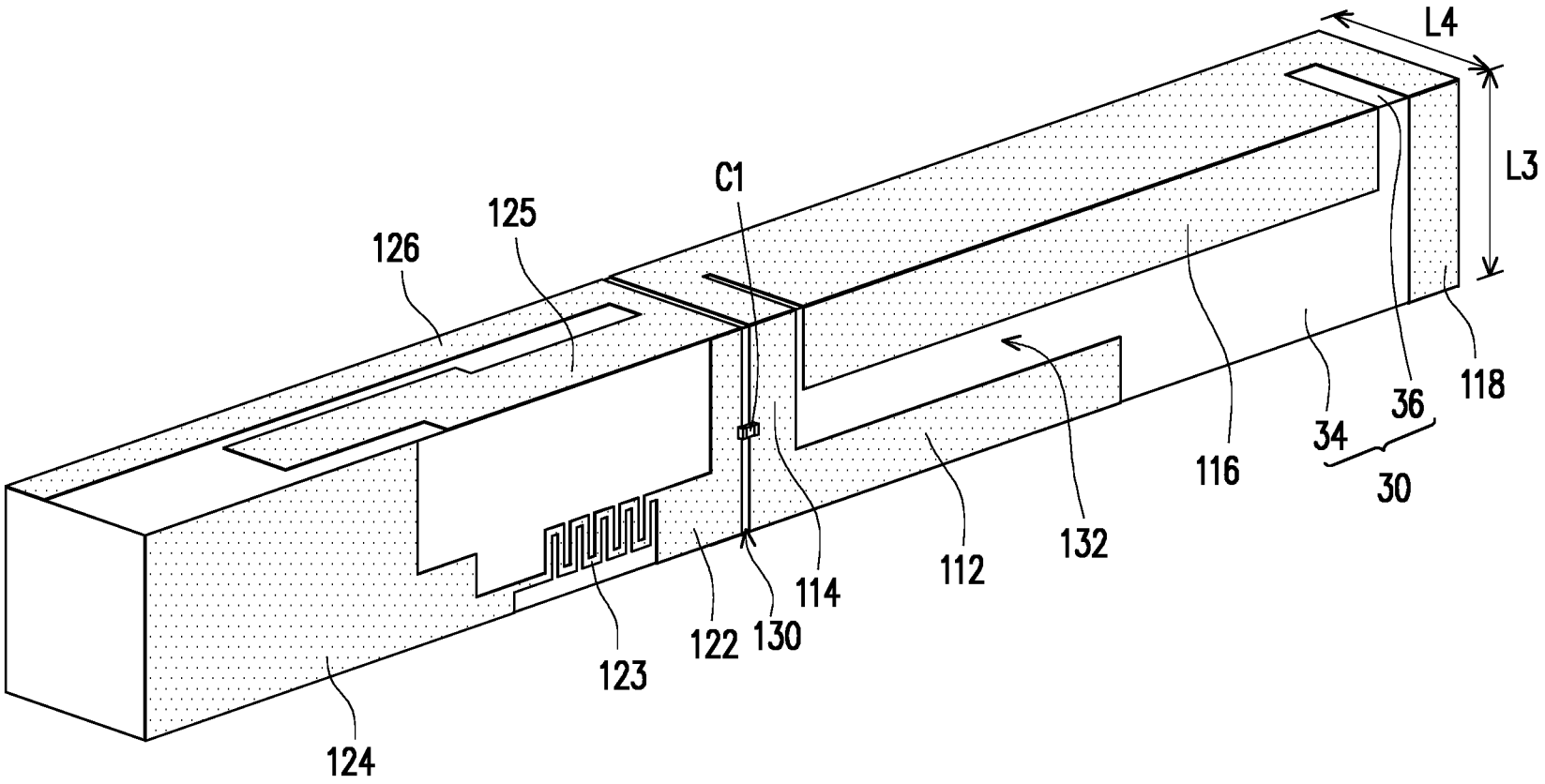
Figure 5:
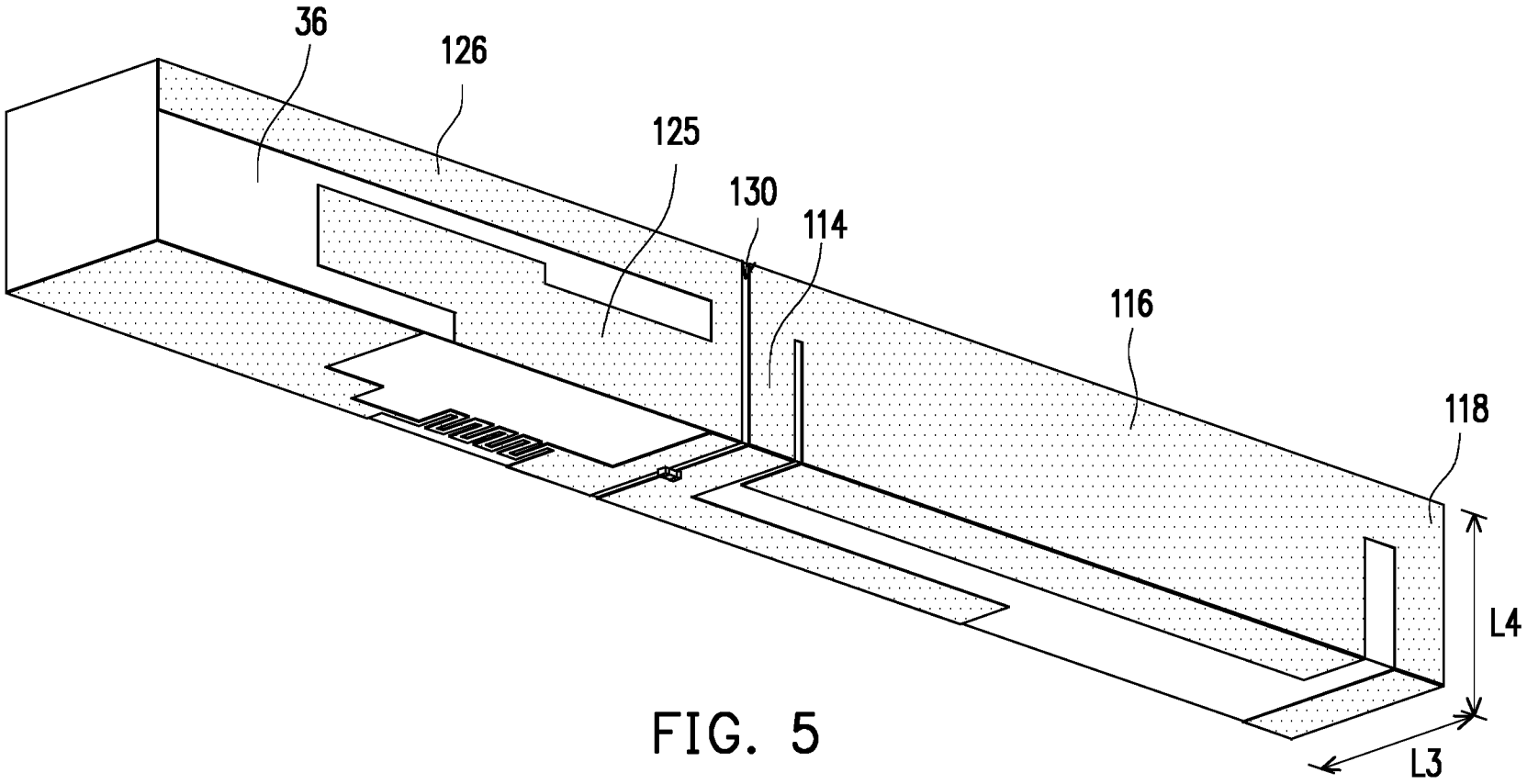

It is worth mentioning that, in the present embodiment, the antenna structure 100 is suitable to be disposed on the insulating bracket 30 to reduce the volume of the communication device and to have good antenna efficiency. FIG. 3 to FIG. 5 are schematic views of the antenna structure according to FIG. 1 disposed on different sides of an insulating bracket. In some embodiments, the material of the insulating bracket 30 is plastic, but the disclosure is not limited thereto.

Please refer to FIG. 1 and FIG. 3 to FIG. 5 altogether. The antenna structure 100 further includes an insulating bracket 30 having a first long side 32, a second long side 34, and a third long side 36 (see FIG. 4). The first long side 32 is connected vertically to the second long side 34, the third long side 36 is connected vertically to the second long side 34, and the first long side 32 is disposed in parallel to the third long side 36. The length of the insulating bracket 30 may correspond to the length L1 of the antenna structure 100 and fall between 75 mm and 95 mm, such as 85 mm. The width of the insulating bracket 30 may correspond to the length L2 of the antenna structure 100 and fall between 8 mm and 10 mm. And the height of the insulating bracket 30 may correspond to the length L3 of the antenna structure 100 and fall between 8 mm and 10 mm. Of course, the above dimensions are not limited thereto.

As shown in FIG. 3, part of the first segment 112 and part of the fourth segment 118 of the first radiator 110 as well as part of the fifth segment 122 and the sixth segment 121 of the second radiator 120 are distributed on the first long side 32 of the insulating bracket 30.

As shown in FIG. 4, the remaining part of the first segment 112, part of the second segment 114, part of the third segment 116, and another part of the fourth segment 118 of the first radiator 110 as well as part of the fifth segment 122 and the seventh segment of the second radiator 120 are distributed on the second long side 34 of the insulating bracket 30.

As shown in FIG. 5, the remaining part of the second segment 114, the remaining part of the third segment 116, and the remaining part of the fourth segment 118 of the first radiator 110 as well as the eighth segment 125 and the ninth segment 126 of the second radiator 120 are distributed on the third long side 36 of the insulating bracket 30.

Figure 6:
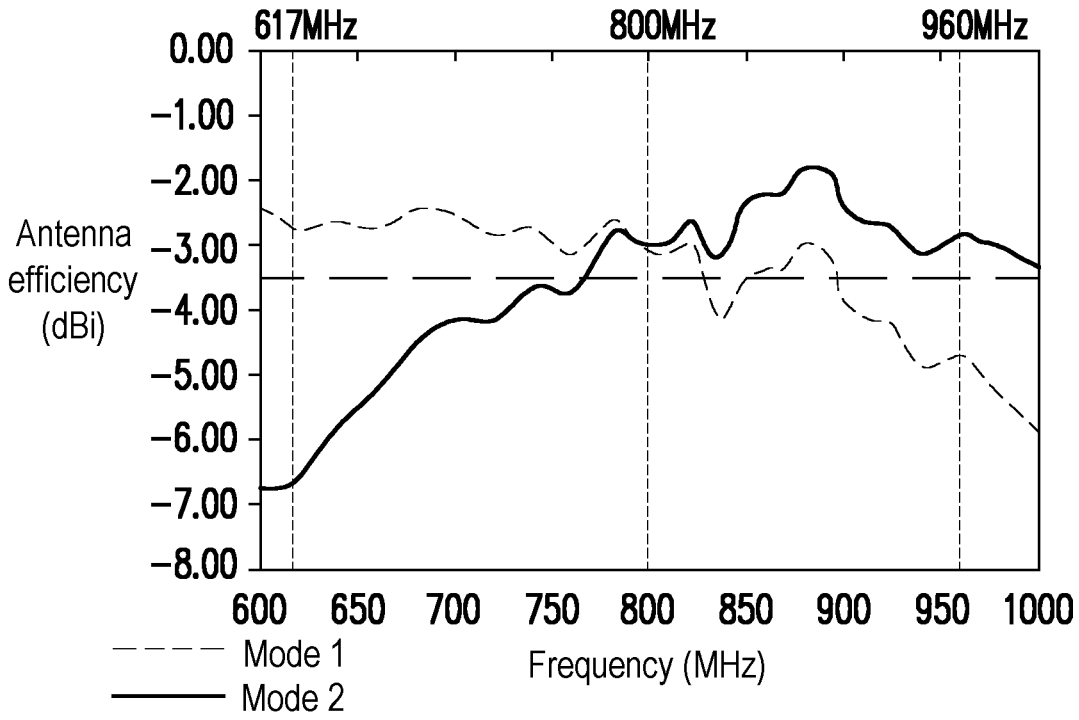
FIG. 6 is a relation chart between the antenna efficiency and the frequency (600 MHz to 1000 MHz) of the communication device according to FIG. 1.

FIG. 6 is a relation chart between the antenna efficiency and the frequency (600 MHz to 1000 MHz) of the communication device according to FIG. 1. As shown in FIG. 6, in the present embodiment, when the switch 20 (see FIG. 2) is switched to mode 1, the antenna efficiency of the first sub-interval (Band 1, 617 MHz to 800 MHz) of the first frequency band (low frequency) is between −2.4 dBi and −3.1 dBi, and when the switch 20 is switched to mode 2, the antenna efficiency of the second sub-interval (Band 2, 800 MHz to 960 MHz) is between −1.8 dBi and −3.1 dBi, which may all be greater than −3.5 dBi, and have a good performance of antenna efficiency.

Figure 7:
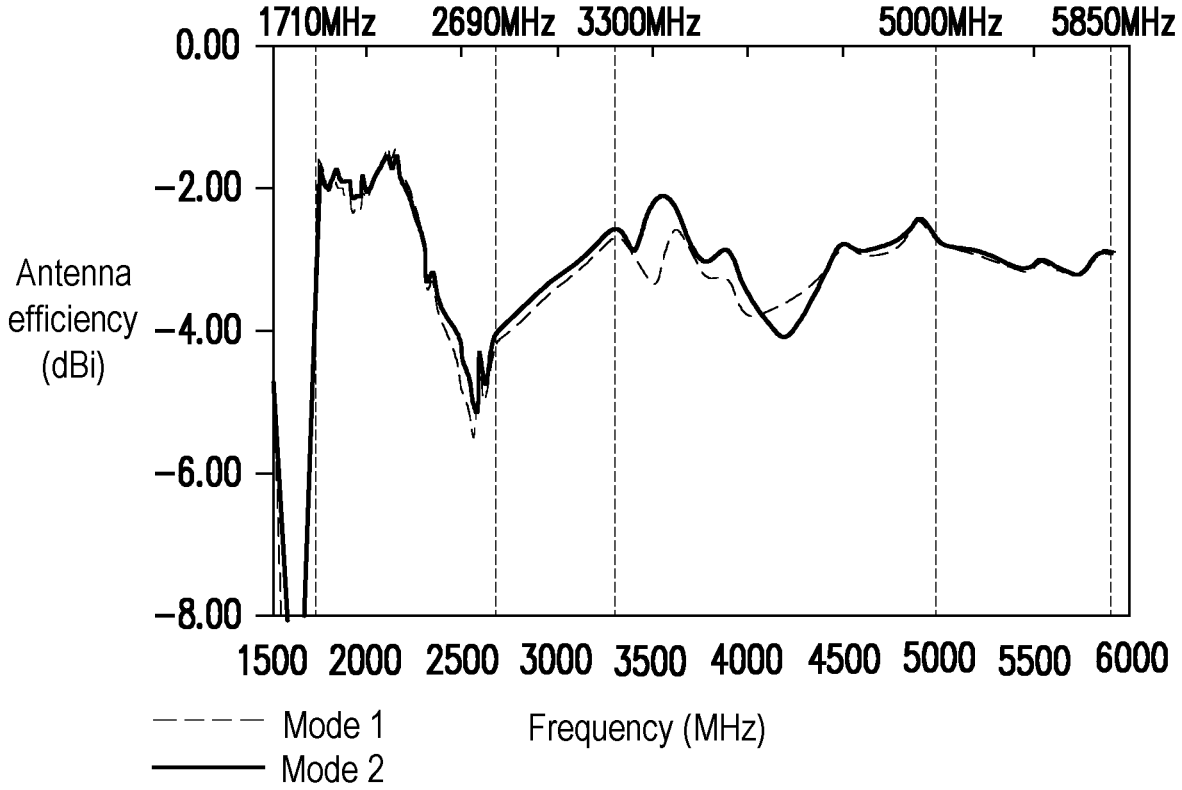
FIG. 7 is a relation chart between the antenna efficiency and the frequency (1500 MHz to 6000 MHz) of the communication device according to FIG. 1.

FIG. 7 is a relation chart between the antenna efficiency and the frequency (1500 MHz to 6000 MHz) of the communication device according to FIG. 1. As shown in FIG. 7, in the present embodiment, when the switch 20 is switched to mode 1, the antenna efficiency of the second frequency band (1710 MHz to 2700 MHz) is between −1.4 dBi and −5.4 dBi, the antenna efficiency of the third frequency band (3300 MHz to 5000 MHz) is between −2.1 dBi and −4.1 dBi, and the antenna efficiency of the fourth frequency band (5150 MHz to 5850 MHz) is between −2.8 dBi and −3.2 dBi, and has a good efficiency performance of LTE 5G-Sub 6G broadband antenna.

In addition, since the differences in the radiation efficiency between the second frequency band (1710 MHz to 2700 MHz), the third frequency band (3300 MHz to 5000 MHz), and the fourth frequency band (5150 MHz to 5850 MHz) are all within 1 dB, it is ensured that it is less affected by the switch 20 when it is activated and thus the disclosure has the feature of good broadband efficiency. In other words, the antenna structure 100 may support a wide frequency band, such as 617 MHz to 960 MHz, at a low frequency while the high frequency does not change much.

As indicated from the above, the antenna structure 100 of the present embodiment forms an adjustable open-loop antenna architecture by forming an open-circuit path by utilizing the feed-in terminal A1 to connect the positions A2, A3, A4, A5, A6, A7, A8, and A9, coupling the first antenna lumped element C1 and the first slit 130 (between positions G1 and G2) in series, connecting the second antenna lumped element L in series via the position B1 with the position B2, B3, B4, B5, B6, and B7 to form the path, and connecting the position B1 (the ground terminal) to the switch 20 of the motherboard such that the switch 20 may switch between and select different ground paths via different switch lumped elements.

The open-circuit path formed by the feed-in terminal A1 of the antenna connecting the positions A2, A3, A4, A5, A6, A7, A8, and A9 may select the ground path corresponding to different sub-intervals at the low frequency through the switch 20 (that is, switching between different inductance or capacitance), so that the low frequency may cover the bandwidth of 617 to 960 MHz. Meanwhile, during the process of switching the low frequency band, its high frequency is less likely to be affected by the frequency shift or impedance matching when switching the low frequency.

In addition, since the frequency band of the antenna structure 100 of the present embodiment covers the frequency band of WiFi, an integrated circuit (not illustrated) of antenna-plexer filtering may also be adapted to adjust to select and switch between 5G, Sub 6G LTE circuit, or WiFi circuit, achieving the effect of antenna sharing and saving the amount of antennas.

In sum of the above, the antenna structure of the disclosure is suitable for coupling to form the first frequency band, the second frequency band, the third frequency band, and the fourth frequency band via the design in which the first radiator includes the first segment, the second segment, the third segment, and a fourth segment all bent to be connected in sequence, the second radiator includes the fifth segment, and the sixth segment, the seventh segment, the eighth segment, and the ninth segment which are connected respectively to the fifth segment, and the fifth segment is located beside the first radiator while the first slit is formed between the first radiator and the fifth segment of the second radiator. Therefore, the antenna structure of the disclosure may achieve the effect of supporting multiple frequency bands. In addition, the communication device of the disclosure may select different ground paths such that the first frequency band may reach a larger coverage of bandwidth via the design of connecting one terminal of the switch to the ground terminal of the antenna structure and connecting the other terminal selectively to at least one of the switch lumped elements.

What is claimed is:

1. An antenna structure, comprising:

a first radiator, comprising a first segment, a second segment, a third segment, and a fourth segment all bent to be connected in sequence, wherein the first segment comprises a feed-in terminal; and a second radiator, comprising a fifth segment, a sixth segment, a seventh segment, an eighth segment, and a ninth segment, wherein the sixth segment, the seventh segment, the eighth segment, and the ninth segment are connected respectively to the fifth segment, the fifth segment is located beside the first radiator, a first slit is formed between the first radiator and the fifth segment of the second radiator, the sixth segment comprises a ground terminal, and the first radiator and the second radiator are coupled to form a first frequency band, a second frequency band, a third frequency band, and a fourth frequency band.

2. The antenna structure according to claim 1, wherein the first frequency band is between 617 MHz and 960 MHz, the second frequency band is between 1710 MHz and 2700 MHz, the third frequency band is between 3300 MHz and 5000 MHz, and the fourth frequency band is between 5150 MHz and 5850 MHz.

3. The antenna structure according to claim 1, wherein a second slit is formed between the first segment and the third segment of the first radiator, and the second slit is suitable for adjusting impedance matching of the third frequency band.

4. The antenna structure according to claim 1, further comprising a first antenna lumped element disposed at the first slit and connecting the first radiator to the second radiator in series, wherein the first antenna lumped element is suitable for adjusting impedance matching of the second frequency band, the third frequency band, and the fourth frequency band.

5. The antenna structure according to claim 3, further comprising a second antenna lumped element, wherein a third slit is formed between the fifth segment and the sixth segment, the second antenna lumped element is disposed on the second slit and connects the fifth segment to the sixth segment in series, and the second antenna lumped element is suitable for adjusting impedance matching of the first frequency band.

6. The antenna structure according to claim 1, wherein the seventh segment comprises a meandering zone and a widened zone, the meandering zone is in a line shape bending back and forth, one terminal of the meandering zone is connected to the fifth segment, the other terminal of the meandering zone is connected to the widened zone, the widened zone is located at a side of the eighth segment opposite to the ninth segment, and a width of the meandering zone is smaller than a width of the widened zone.

7. The antenna structure according to claim 1, wherein the sixth segment, the seventh segment, the eighth segment, and the ninth segment extend in a same direction and are not connected to one another.

8. The antenna structure according to claim 1, further comprising an insulating bracket comprising a first long side, a second long side, and a third long side, wherein part of the first segment and part of the fourth segment of the first radiator as well as part of the fifth segment and the sixth segment of the second radiator are distributed on the first long side of the insulating bracket, remaining part of the first segment, part of the second segment, part of the third segment, and another part of the fourth segment of the first radiator as well as part of the fifth segment and the seventh segment of the second radiator are distributed on the second long side of the insulating bracket, and remaining part of the second segment, remaining part of the third segment, and remaining part of the fourth segment of the first radiator as well as the eighth segment and the ninth segment of the second radiator are distributed on the third long side of the insulating bracket.

9. The antenna structure according to claim 8, wherein the insulating bracket comprises a length, a width and a height, the length is between 75 mm and 95 mm, the width is between 8 mm and 10 mm, and the height is between 8 mm and 10 mm.

10. A communication device, comprising:

an antenna structure, comprising:

a first radiator, comprising a first segment, a second segment, a third segment, and a fourth segment all bent to be connected in sequence, wherein the first segment comprises a feed-in terminal; and a second radiator, comprising a fifth segment, a sixth segment, a seventh segment, an eighth segment, and a ninth segment, wherein the sixth segment, the seventh segment, the eighth segment, and the ninth segment are connected respectively to the fifth segment, the fifth segment is located beside the first radiator, a first slit is formed between the first radiator and the fifth segment of the second radiator, the sixth segment comprises a ground terminal, and the first radiator and the second radiator are coupled to form a first frequency band, a second frequency band, a third frequency band, and a fourth frequency band, wherein the first frequency band comprises a plurality of sub-intervals;

a plurality of switch lumped elements, connected to a system ground plane, wherein a plurality of ground paths are formed between the antenna structure and the system ground plane, and the ground paths correspond respectively to the sub-intervals of the first frequency band; and a switch, wherein one terminal of the switch is connected to the ground terminal of the antenna structure, and the other terminal is connected selectively to at least one of the switch lumped elements to connect the antenna structure to at least one of the ground paths and resonate at one of the sub-intervals of the first frequency band.

11. The communication device according to claim 10, wherein the switch lumped elements comprise a capacitance or an inductance.

12. The communication device according to claim 10, wherein the switch lumped elements comprise a first switch lumped element, a second switch lumped element, and a third switch lumped element, the ground paths comprise a plurality of ground paths, the sub-intervals of the first frequency band comprise a first sub-interval and a second sub-interval, when the switch is connected to the third switch lumped element, the antenna structure is suitable for resonating at the first sub-interval of the first frequency band, and when the switch is connected to the first switch lumped element, the second switch lumped element, and the third switch lumped element, the antenna structure is suitable for resonating at the second sub-interval of the first frequency band.

13. The communication device according to claim 12, wherein the first second switch lumped element, the second switch lumped element, and the third switch lumped element are respectively three inductances, an inductance value of the third switch lumped element is greater than an inductance value of the second switch lumped element, and an inductance value of the second switch lumped element is greater than an inductance value of the first switch lumped element.

14. The communication device according to claim 12, wherein the first sub-interval is between 617 MHz and 800 MHz, and the second sub-interval is between 800 MHz and 960 MHz.

15. The communication device according to claim 10, wherein the first frequency band is between 617 MHz and 960 MHz, the second frequency band is between 1710 MHz and 2700 MHz, the third frequency band is between 3300 MHz and 5000 MHz, and the fourth frequency band is between 5150 MHz and 5850 MHz.

16. The communication device according to claim 10, wherein a second slit is formed between the first segment and the third segment of the first radiator, and the second slit is suitable for adjusting impedance matching of the third frequency band.

17. The communication device according to claim 10, wherein the antenna structure further comprises a first antenna lumped element, disposed at the first slit and connecting the first radiator to the second radiator in series, and the first antenna lumped element being suitable for adjusting impedance matching of the second frequency band, the third frequency band, and the fourth frequency band.

18. The communication device according to claim 16, wherein the antenna structure further comprises a second antenna lumped element, wherein a third slit is formed between the fifth segment and the sixth segment, the second antenna lumped element is disposed on the second slit and connects the fifth segment to the sixth segment in series, and the second antenna lumped element is suitable for adjusting impedance matching of the first frequency band.

19. The communication device according to claim 10, wherein the seventh segment comprises a meandering zone and a widened zone, the meandering zone is in a line shape bending back and forth, one terminal of the meandering zone is connected to the fifth segment, the other terminal of the meandering zone is connected to the widened zone, the widened zone is located at a side of the eighth segment opposite to the ninth segment, and a width of the meandering zone is smaller than a width of the widened zone.

20. The communication device according to claim 10, wherein the sixth segment, the seventh segment, the eighth segment, and the ninth segment extend in a same direction and are not connected to one another.

21. The communication device according to claim 10, wherein the antenna structure further comprises an insulating bracket comprising a first long side, a second long side, and a third long side, wherein part of the first segment and part of the fourth segment of the first radiator as well as part of the fifth segment and the sixth segment of the second radiator are distributed on the first long side of the insulating bracket, remaining part of the first segment, part of the second segment, part of the third segment, and another part of the fourth segment of the first radiator as well as part of the fifth segment and the seventh segment of the second radiator are distributed on the second long side of the insulating bracket, and remaining part of the second segment, remaining part of the third segment, and remaining part of the fourth segment of the first radiator as well as the eighth segment and the ninth segment of the second radiator are distributed on the third long side of the insulating bracket.

22. The communication device according to claim 21, wherein the insulating bracket comprises a length, a width and a height, the length is between 75 mm and 95 mm, the width is between 8 mm and 10 mm, and the height is between 8 mm and 10 mm.

* * * * *